US009221065B1

(12) United States Patent
Renquist

(10) Patent No.: US 9,221,065 B1
(45) Date of Patent: Dec. 29, 2015

(54) HELICAL WATER DISTRIBUTION RESTRICTOR

(75) Inventor: Steven C. Renquist, Chino Hills, CA (US)

(73) Assignee: The Toro Company, Bloomington, MN (US)

( * ) Notice: Subject to any disclaimer, the term of this patent is extended or adjusted under 35 U.S.C. 154(b) by 1598 days.

(21) Appl. No.: 11/625,776

(22) Filed: Jan. 22, 2007

(51) Int. Cl.
*B05B 1/34* (2006.01)
*B05B 1/18* (2006.01)

(52) U.S. Cl.
CPC ..... *B05B 1/185* (2013.01); *B05B 1/3436* (2013.01)

(58) Field of Classification Search
USPC ..... 239/204, 203, 436, 302, 327, 135, 488, 239/489, 600, 490, 487, 463, 456, 465
See application file for complete search history.

(56) References Cited

U.S. PATENT DOCUMENTS

| | | | | | |
|---|---|---|---|---|---|
| 664,067 | A | * | 12/1900 | Turner | 239/487 |
| 1,146,394 | A | | 7/1915 | Best | |
| 1,395,442 | A | * | 11/1921 | MacGregor | 239/472 |
| 1,667,943 | A | | 3/1922 | Munz | |
| 1,731,813 | A | * | 10/1929 | Bloom | 239/116 |
| 2,083,282 | A | * | 6/1937 | Thompson | 239/465 |
| 2,086,074 | A | * | 7/1937 | Del Genovese | 239/465 |
| 2,305,210 | A | | 12/1942 | Wahlin | |
| 2,639,941 | A | * | 5/1953 | Glynn | 239/204 |
| 2,709,623 | A | * | 5/1955 | Glynn | 239/488 |
| 2,981,483 | A | * | 4/1961 | Pichon | 239/464 |
| 3,054,563 | A | * | 9/1962 | Steinen | 239/492 |
| 3,275,248 | A | | 9/1966 | O'Brien et al. | |
| 3,655,132 | A | | 4/1972 | Rosic | |
| 3,716,192 | A | | 2/1973 | Hunter | |
| 3,794,245 | A | | 2/1974 | Wilson | |
| 3,920,187 | A | | 11/1975 | Willis | |
| 3,921,912 | A | | 11/1975 | Hayes | |
| 4,269,354 | A | * | 5/1981 | DeWitt | 239/97 |
| 4,498,626 | A | | 2/1985 | Pitchford | |
| 5,104,045 | A | | 4/1992 | Kah, Jr. | |
| 5,240,184 | A | | 8/1993 | Lawson | |
| 5,810,259 | A | * | 9/1998 | Sinclair | 239/383 |
| 5,975,430 | A | * | 11/1999 | Larsen | 239/205 |
| 6,332,581 | B1 | | 12/2001 | Chin et al. | |
| 6,923,383 | B1 | * | 8/2005 | Joshi et al. | 239/302 |
| 2003/0218082 | A1 | | 11/2003 | Malcolm | |
| 2005/0284956 | A1 | * | 12/2005 | Mast | 239/288 |

FOREIGN PATENT DOCUMENTS

| | | |
|---|---|---|
| DE | 765 232 | 8/1954 |
| GB | 14724 | 10/1908 |
| GB | 161937 | 6/1922 |

* cited by examiner

*Primary Examiner* — Len Tran
*Assistant Examiner* — Tuongminh Pham
(74) *Attorney, Agent, or Firm* — Inskeep IP Group, Inc.

(57) ABSTRACT

One embodiment provides a helical restrictor insert for a sprinkler nozzle. The helical thread of the insert imparts a helical swirl into the water stream which changes the flow and distribution pattern of the water leaving the nozzle. The position of the end of the helical thread can be adjusted to direct a portion of the water stream downward, close to the sprinkler head without adversely affecting the nearby turf.

13 Claims, 6 Drawing Sheets

Figure 4
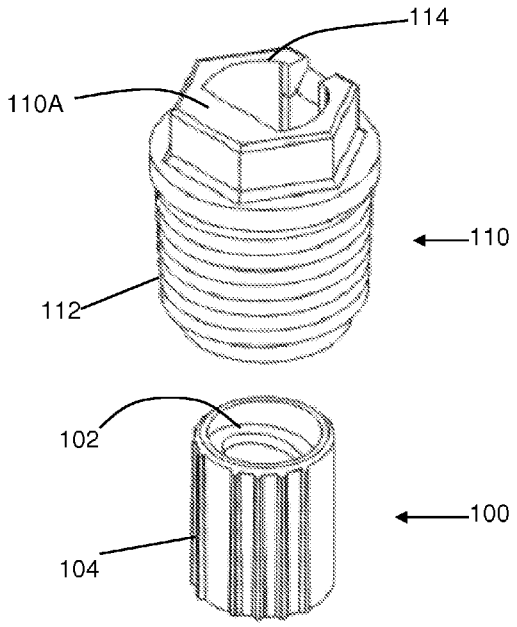
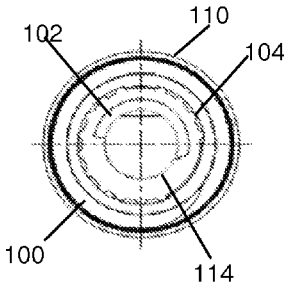
Figure 5
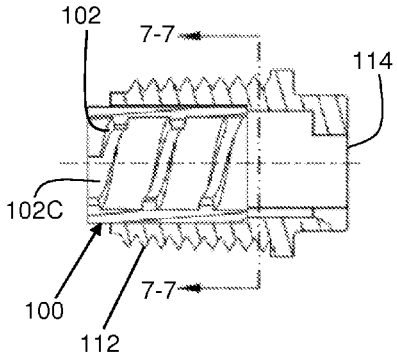
Figure 6
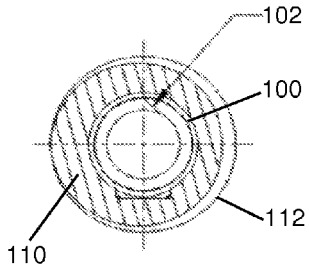
Figure 7

Figure 9
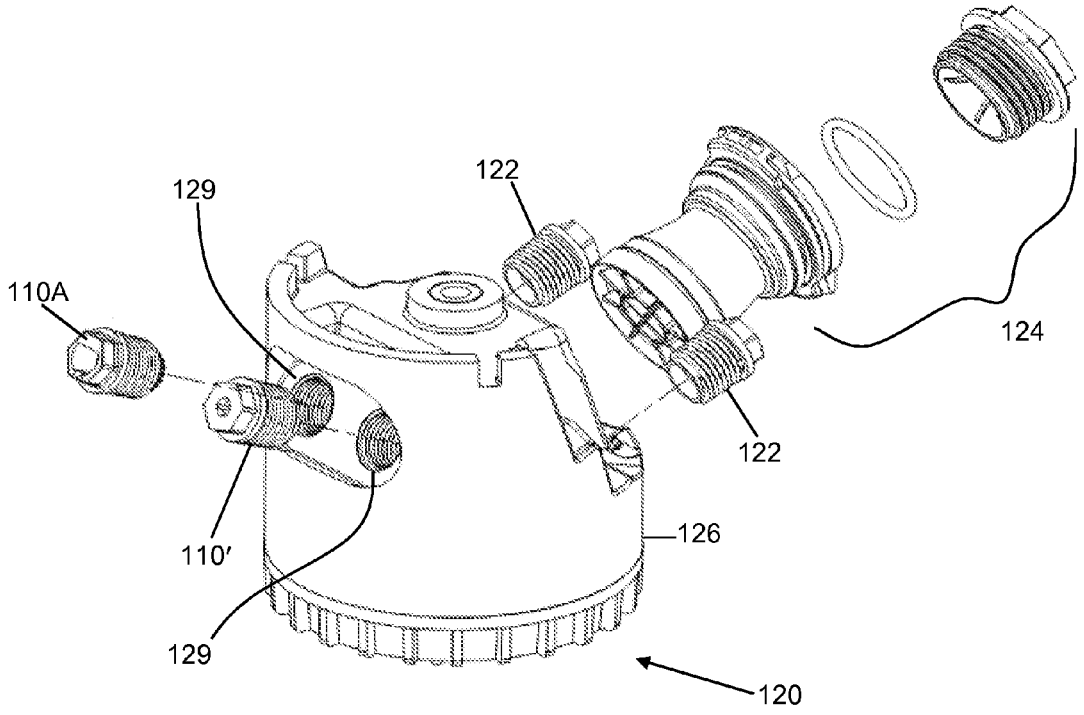
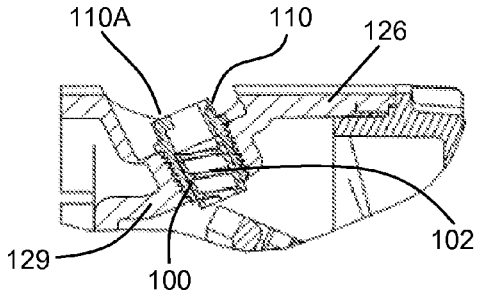
Figure 10

HELICAL WATER DISTRIBUTION RESTRICTOR

BACKGROUND OF THE INVENTION

Sprinkler systems for turf irrigation are well known. Typical systems include a plurality of valves and sprinkler heads in fluid communication with a water source, and a centralized controller connected to the water valves. At appropriate times the controller opens the normally closed valves to allow water to flow from the water source to the sprinkler heads. Water then issues from the sprinkler heads in predetermined fashion.

There are many different types of sprinkler heads, including above-the-ground heads and "pop-up" heads. Pop-up sprinklers, though generally more complicated and expensive than other types of sprinklers, are thought to be superior. There are several reasons for this. For example, a pop-up sprinkler's nozzle opening is typically covered when the sprinkler is not in use and is therefore less likely to be partially or completely plugged by debris or insects. Also, when not being used, a pop-up sprinkler is entirely below the surface and out of the way.

The typical pop-up sprinkler head includes a stationary body and a "riser" which extends vertically upward, or "pops up," when water is allowed to flow to the sprinkler. The riser is in the nature of a hollow tube which supports a nozzle at its upper end. When the normally-closed valve associated with a sprinkler opens to allow water to flow to the sprinkler, two things happen: (i) water pressure pushes against the riser to move it from its retracted to its fully extended position, and (ii) water flows axially upward through the riser, and the nozzle receives the axial flow from the riser and turns it radially to create a radial stream. A spring or other type of resilient element is interposed between the body and the riser to continuously urge the riser toward its retracted, subsurface, position, so that when water pressure is removed the riser assembly will immediately return to its retracted position.

The riser assembly of a pop-up or above-the-ground sprinkler head can remain rotationally stationary or can include a portion that rotates in continuous or oscillatory fashion to water a circular or partly circular area, respectively. More specifically, the riser assembly of the typical rotary sprinkler includes a first portion (e.g. the riser), which does not rotate, and a second portion, (e.g., the nozzle assembly) which rotates relative to the first (non-rotating) portion.

The rotating portion of a rotary sprinkler riser typically carries a nozzle at its uppermost end. The nozzle throws at least one water stream outwardly to one side of the nozzle assembly. As the nozzle assembly rotates, the water stream travels or sweeps over the ground, creating a watering arc.

One drawback with this type of sprinkler nozzle is uneven coverage and distribution of water. Typically, if water is thrown in a coherent stream at some trajectory relative to the surface to be watered, the stream will tend to water a doughnut shaped ring around the sprinkler with little water being deposited close to the sprinkler. This is obviously a disadvantage since the vegetation closest to the sprinkler will be under-watered. One way of compensating for this could be to increase the length of time the sprinkler is allowed to run. However, increasing water usage to ensure proper watering of vegetation closest to the sprinkler also means that vegetation further away from the sprinkler (i.e., in the outer radial portions of the watering pattern) will then be over-watered.

Another drawback associated with conventional sprinkler nozzle designs involves water turbulence. For example, as water flows through the fluid passageway of a nozzle, it impacts against the walls or surfaces of the passageway. Water flowing through the passageway and impacting against the surface often changes the stream of water exiting the nozzle from a substantially droplet form into a spray or mist form. As such, water thrown in a spray or mist form is easily blown by the wind and, thereby, produces inaccurate and uneven irrigation of the target area.

To compensate for uneven water distribution, sprinkler systems must be arranged so that the spray patterns of each sprinkler overlap with one another. Known in the industry as head-to-head coverage or head-to-head spacing, this type of sprinkler arrangement ensures overlap of watered areas to produce uniform water application. However, this arrangement tends to be rather costly and labor intensive at the initial set-up due to the quantity of sprinkler heads and accessory components required. Further, as with any system, the greater the number of components, the greater the cost to maintain such a system.

In view of the above, there is a need for an improved sprinkler nozzle for both above-the ground and pop-up rotary sprinkler systems. In particular, it is desirable that the nozzle applies water in a uniform pattern that provides even coverage and distribution of water. In addition, the nozzle should also be configured to include a broad throw pattern with even water distribution over the entire area. Furthermore, it is desirable that the nozzle reduce water turbulence in order to deliver optimum water-efficient coverage over the irrigation surface.

OBJECTS AND SUMMARY OF THE INVENTION

It is an object of the present invention to provide an improved irrigation sprinkler nozzle system that overcomes the disadvantages of the prior art.

The present invention seeks to achieve this object in one preferred embodiment by providing a helical restrictor insert for a sprinkler nozzle. The helical thread of the insert imparts a helical swirl into the water stream which changes the flow and distribution pattern of the water after leaving the nozzle. The position of the end of the helical thread can be positioned in line with the vertical axis of the sprinkler head to direct a portion of the water stream downward, close to the sprinkler head without adversely affecting the nearby turf (e.g., affecting loose soil or washing away grass seeds).

BRIEF DESCRIPTION OF THE DRAWINGS

FIG. 4 illustrates a perspective view of a nozzle and insert according to a preferred embodiment of the present invention;

FIG. 5 illustrates an end view of the nozzle and insert of FIG. 4;

FIG. 6 illustrates a side cross sectional view of the nozzle and insert of FIG. 4;

FIG. 7 illustrates a cross sectional view taken along lines 7-7 in FIG. 6;

FIG. 9 illustrates a rear exploded view of the nozzle base of FIG. 9; and FIG. 10 illustrates a magnified cross sectional view of the nozzle base of FIG. 8.

DETAILED DESCRIPTION OF THE INVENTION

Figure 1:
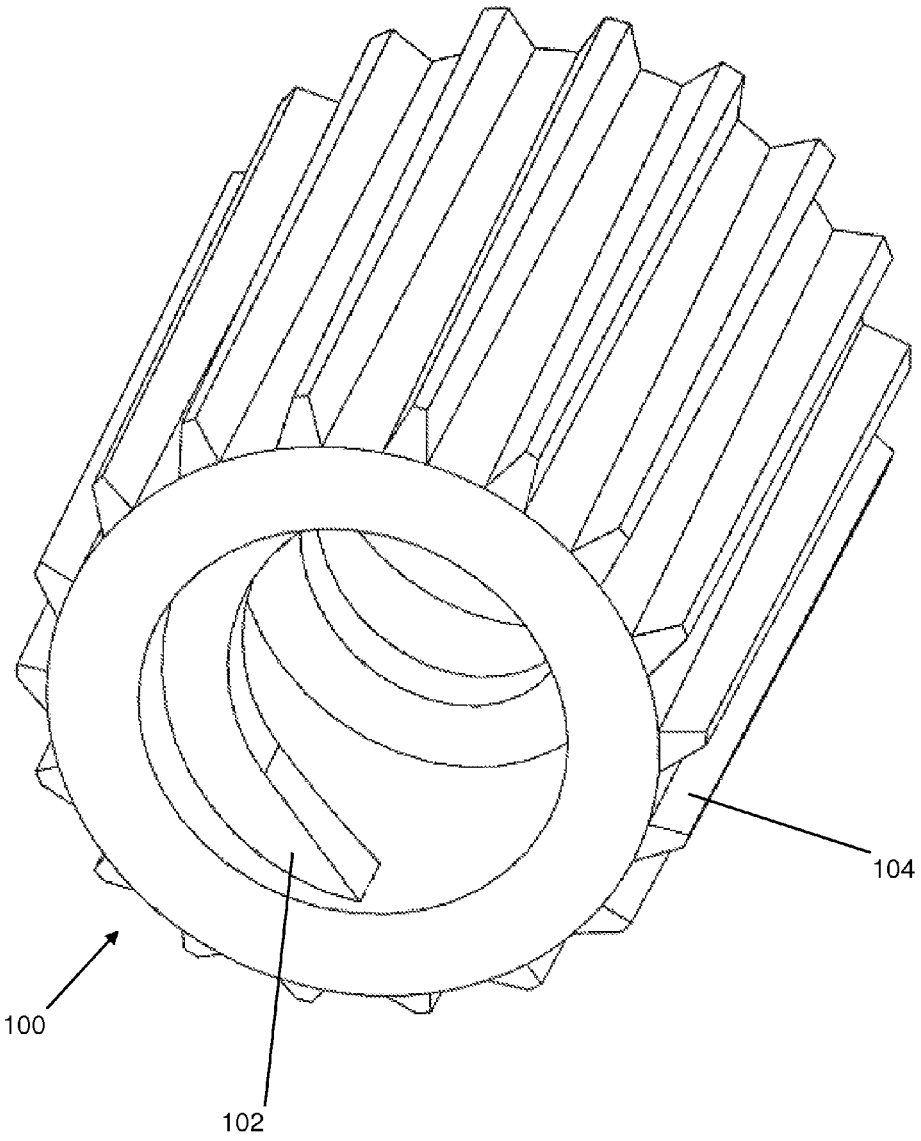
FIG. 1 illustrates a perspective view of a flow restrictor insert 100 according to a preferred embodiment of the present invention.
Figure 2:
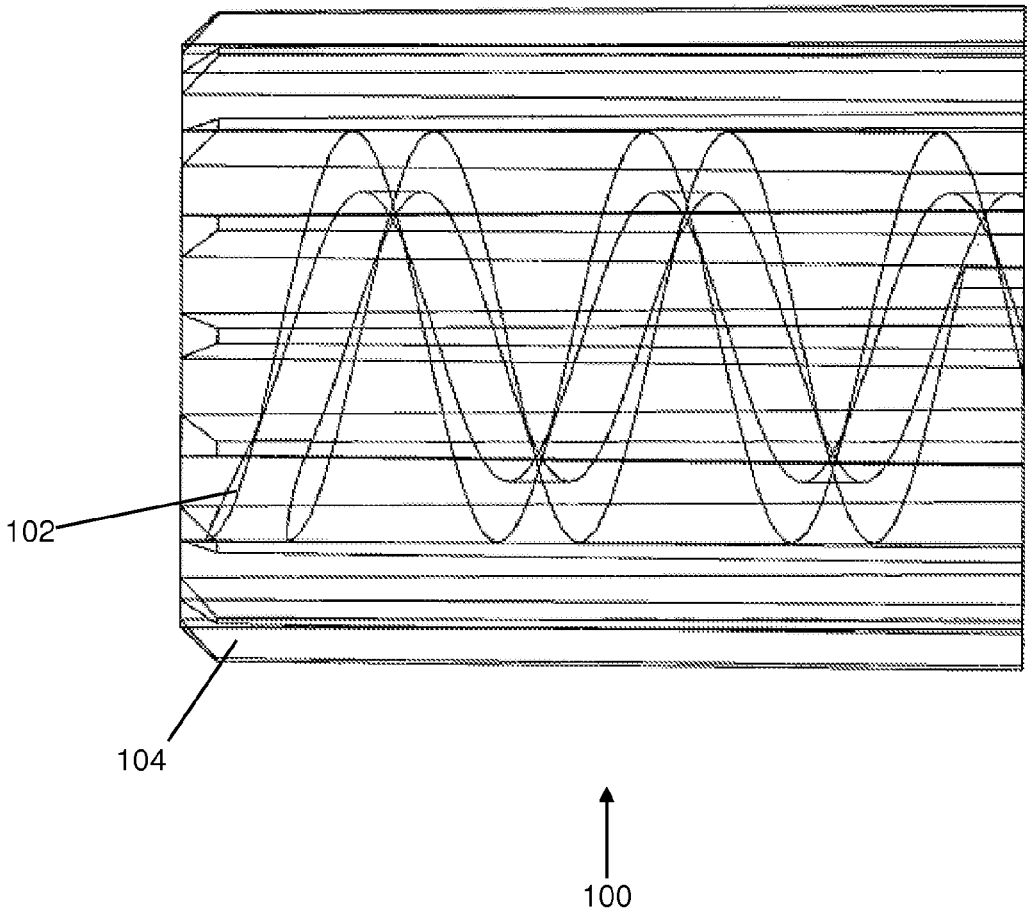
FIG. 2 illustrates a side transparent view of the insert of FIG. 1.
Figure 3:
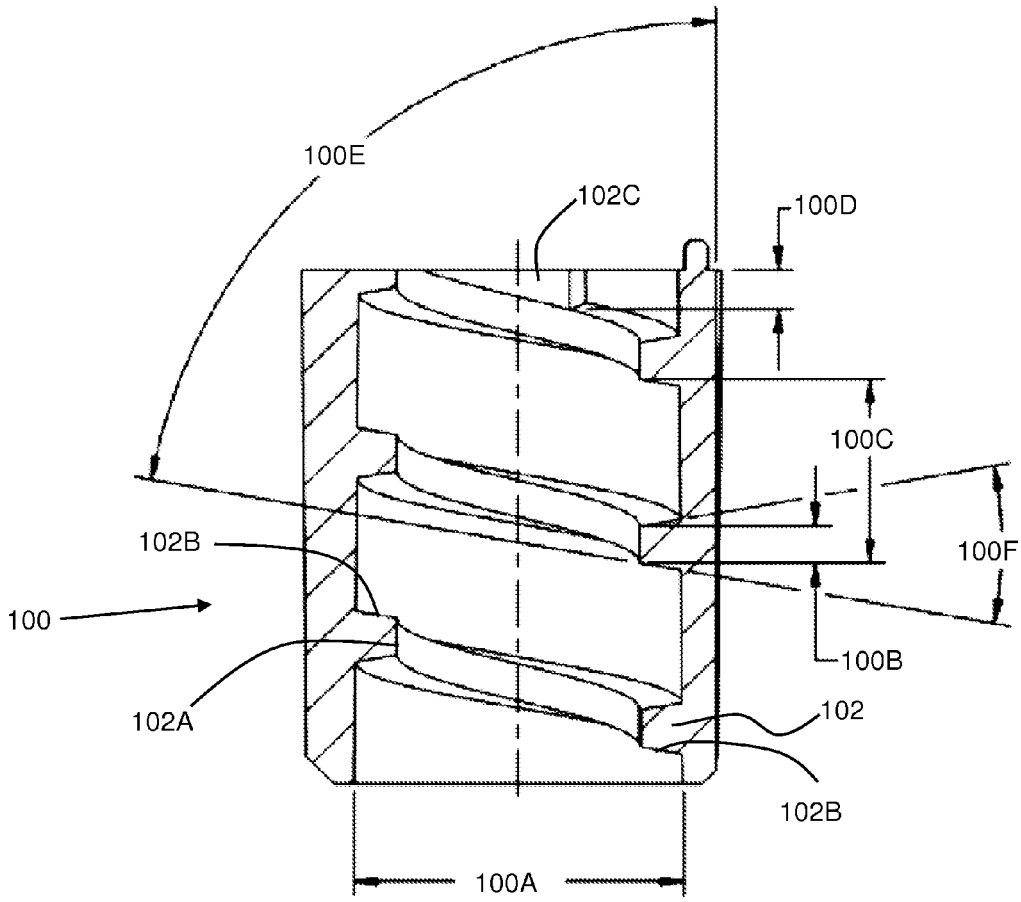
FIG. 3 illustrates a side cross sectional view of the insert of FIG. 1.

FIGS. 1-3 illustrate a preferred embodiment of a flow restrictor insert 100 according to the present invention for imparting a swirl or rotational component to the exiting water stream of the sprinkler. The restrictor insert 100 has a generally tubular shape, including a helical thread 102 that winds along an inner surface of the insert 100. Generally, the insert 100 is positioned within a sprinkler, near a nozzle so that the flow path of the water exiting the sprinkler travels through the inner passage of the insert 100.

As the water passes through the insert 100, the outer diameter of the water stream is directed along the helical thread 102, causing an outer diameter of the water stream to swirl and reduce speed. The water stream then exits the sprinkler nozzle with an outer swirling portion of the stream that breaks off from a main portion of the stream, disbursing water over a larger area. In one example, the swirling portion of the stream can be directed towards nearby turf (e.g., by changing the rotational orientation of the insert within the sprinkler), allowing for improved "close up" irrigation.

This swirling motion generally produces larger droplets which are less affected by wind, thereby directing more water to its intended area. Additionally, the swirling motion produced from the insert 100 provides an improved distribution pattern, usually over the first 30 feet of the water stream from a typical sprinkler while allowing for optional adjustment of the insert 100 to achieve "close in" watering (i.e., better water distribution close to the sprinkler).

Generally, as the pitch of the thread 102 is increased, the swirl of the water stream increases and as the pitch decreases, the swirl decreases. Additionally, as the height of the thread 102 increases (i.e., the thread 102 further extends into the passage to decrease the diameter of the inner passage), the swirl of the stream also increases while a decrease in the height of the thread 102 decreases the swirl imparted to the stream. In this respect, the insert 100 can be shaped to achieve a desired swirl.

In one example, the pitch of the thread 102 is between about 8 and 10 threads per inch and about 0.06 to 0.160 inches minimum thread diameter (i.e., the diameter formed by the inner edge of the thread 102).

Referring to FIG. 3, a cross sectional view of the flow restrictor insert 100 is illustrated. In one specific example, the inner diameter 100A (i.e., diameter of the inner passage) is about 0.242 inches, the thread 102 has an inner diameter height 100B (i.e., the thickness of the thread 102 at its free side 102A) of about 0.025 inches, a thread spacing 100C of about 0.125 inches, a terminating portion 102C of the thread 102 has a height of about 0.027 inches, the angle 100E of the upper and lower thread surfaces 102B relative to the axis of the inner passage is about 80 degrees and the angle between both surfaces 102B is about 20 degrees.

Referring to FIGS. 4-7, the insert 100 preferably fits within the inner passage of a nozzle 110. The nozzle 110 includes axial grooves (not shown) along its inner passage that mates with ridges 104 on the outer surface of the insert 100. The insert 100 depicted in FIGS. 1 and 2 have evenly spaced ridges 104 which allow the insert 100 to be rotated to any angle relative to the sprinkler. Conversely, the ridges 104 may be positioned in an irregular pattern and similarly matched by the axial grooves of the nozzle 110, allowing for only a single or select number of rotational orientations. In this respect, the user may have the freedom of changing the orientation of the insert 100 (and therefore the thread 102) to any rotational orientation or may have the ease of use of a single or highly limited number of orientations. It should be understood that other mechanisms to restrict rotational orientations of the insert 100 may also be possible, such as various mating circumferential shapes or flanges.

Figure 8:
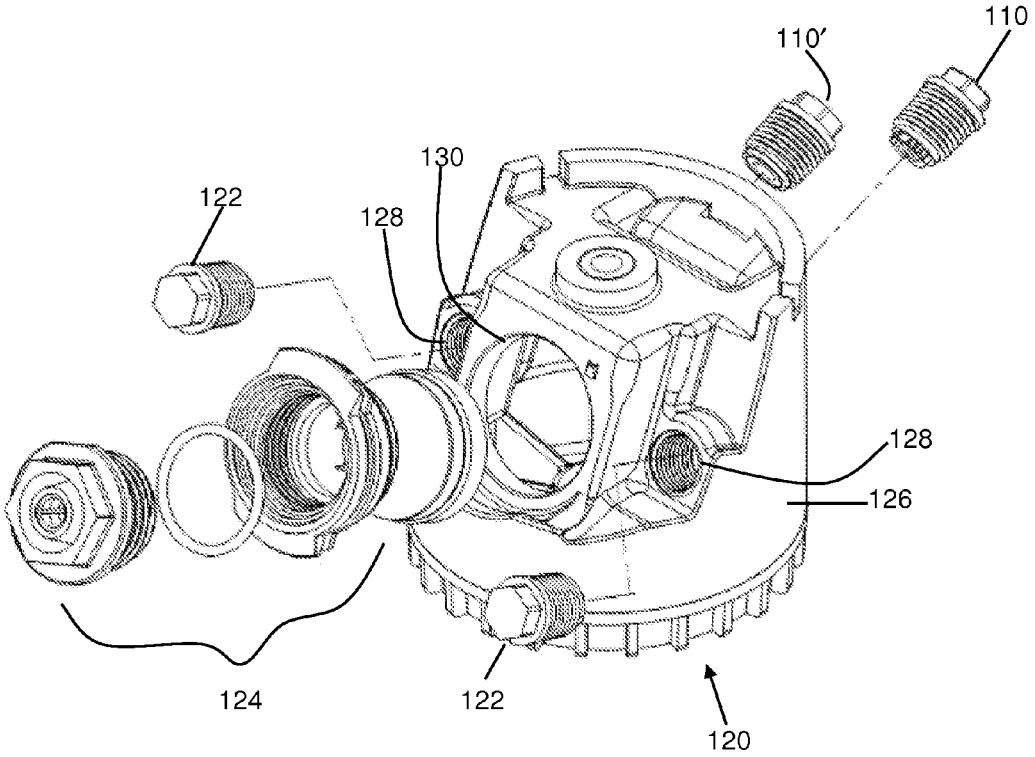
FIG. 8 illustrates an exploded view of a nozzle base of a sprinkler according to a preferred embodiment of the present invention.

FIGS. 8-10 illustrate various exploded views of the insert 100 and nozzle 110 as part of a nozzle base 120 of a sprinkler. This example nozzle base 120 can also be seen in U.S. Provisional Application 60/772,498 filed Feb. 10, 2006, the contents of which are hereby incorporated by reference.

The nozzle base 120 is comprised of a housing 126 having a main nozzle opening 130, two front secondary nozzle openings 128 and two rear secondary nozzle openings 129. As best seen in FIG. 8, a main nozzle assembly 124 is disposed within the main nozzle opening 130 for dispensing a primary water stream onto the surrounding turf. The two front secondary nozzle openings 128 can accept plugs 122 to block up openings 128 or nozzles 110 or 110' for distributing water to areas that are not easily reachable by the primary water stream (e.g., areas close to the sprinkler).

The two rear secondary nozzle openings 129 can similarly accept the plugs 122 or, as pictured in FIGS. 8-10, nozzles 110 and 110'. These rear secondary nozzle openings 129 allow the sprinkler to simultaneously distribute water in an opposite direction of the primary water stream. As previously discussed, the insert 100 within the nozzles 110 or 110' can be oriented to disburse the water to desired or hard to reach areas (e.g., close to the sprinkler).

As seen best in FIG. 9, nozzle 110 includes an outer restricting portion 110A while nozzle 110' includes a smaller diameter opening. It should be understood that many different nozzle designs can be used with the insert 100 of the present invention. In operation, the sprinkler is pressurized with water which flows into the nozzle base 120. The water then moves out of the main nozzle assembly 124 and any of the front secondary nozzle openings 128 or rear secondary nozzle openings 129 having nozzles 110 or 110' within them. A portion of the water thrown from the nozzle 110 is directed away from the axis of the nozzle opening (i.e., away from the trajectory of a main portion of the water stream due to the helical thread 102), allowing the user to rotate the insert and direct the off-axis spray towards a desired target, such as the turf immediately surrounding the sprinkler.

Preferably the insert 100 is made from plastic, molded with an outer mold and an inner unwinding core. After the plastic has solidified within the mold, the unwinding core rotates within the insert 100 as the outer surface of the insert 100 is held and thereby prevented from rotation with the unwinding core. The unwinding core is finally rotated to eject the insert 100.

While the insert 100 has been described as a separate insert for a nozzle, another preferred embodiment may incorporate the structure of the insert 100, including the helical threads 102 with the nozzle as a single unitary piece. Further, this nozzle may be rotated relative to the nozzle base to achieve a desired distribution pattern on the surrounding turf. Additionally, the nozzle may include indicia on the outside surface of the nozzle to communicate the distribution pattern of the water when the nozzle is rotated at a specific orientation. For example, a top portion of the nozzle may indicate close up watering when the thread is rotationally oriented to disburse water near to the sprinkler.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A method of distributing water from an irrigation sprinkler comprising:

providing a sprinkler having a passage connectable to a water supply and a nozzle connected to said passage of said sprinkler to disburse water;

providing a flow restrictor comprising:

a restrictor passage passing through an interior of said flow restrictor; said restrictor passage having a diameter;

an outer surface; said outer surface being shaped to removably mate with an interior surface of said nozzle; and, a raised helical thread along a length of a surface of said restrictor passage; said helical thread having a height smaller than a cross sectional diameter of said restrictor passage so as to allow a portion of said water to pass substantially linearly through said restrictor passage;

pressurizing said sprinkler passage with said water;

passing said water through said restrictor passage to impart a rotational movement to an outer region of said water and to maintain substantially straight, non-rotational movement at an inner region of said water;

disbursing a water stream from said nozzle, said nozzle stream having an inner cross sectional area having a non-rotational component and an outer cross sectional area having a rotational component;

wherein said flow restrictor removably mates in at least a first rotational orientation and a second rotational orientation.

2. The method of claim 1, wherein said raised helical thread includes a thread pitch between 8-10 threads per inch.

3. The method of claim 2, wherein said disbursing said water from said nozzle includes creating droplets sized to resist movement from wind.

4. The method of claim 1, wherein said disbursing said water from said nozzle includes disbursing water within close proximity of said sprinkler.

5. The method of claim 1, further comprising rotating said flow restrictor so as to direct an off-axis spray at a desired target area.

6. An irrigation sprinkler comprising:

a body having a passage with a first opening connectable to a water supply and a second opening for disbursing water;

a nozzle removably coupled at said second opening and further comprising a nozzle passage with an interior nozzle surface;

a flow restrictor comprising:

a restrictor body;

a restrictor passage located within said restrictor body;

an outer restrictor surface; said restrictor passage having an outer circumferential region in which a helical thread is located and an inner region that is clear of said helical thread;

wherein said flow restrictor creates a first water stream having a substantially straight trajectory and a second water stream located around said first water stream; said second water stream having a substantially rotational trajectory relative to said first water stream.

7. The irrigation sprinkler of claim 6, said outer restrictor surface having a first mating feature engagable with a second mating feature within said sprinkler to prevent rotation of said restrictor relative to said nozzle.

8. The irrigation sprinkler of claim 7, wherein said first mating feature is a plurality of axial ridges and said second mating feature is a plurality of axial grooves.

9. The irrigation sprinkler of claim 8, wherein said first mating feature and said second mating feature are arranged in an irregular, mating pattern.

10. The irrigation sprinkler of claim 6, wherein said raised spiral thread has an inner diameter height of about 0.025 inches.

11. The irrigation sprinkler of claim 6, wherein said spiral thread includes a pitch between about eight and ten threads per inch.

12. The irrigation sprinkler of claim 6, wherein said rotational movement of said outer circumferential region of said water stream creates an off-axis stream.

13. An irrigation sprinkler comprising:

a sprinkler body having a passage with a first opening connectable to a water supply and a second opening for disbursing water;

a nozzle removably coupled at said second opening;

a flow restrictor comprising:

a restrictor body disposed within said passage of said sprinkler body;

a restrictor passage located within said restrictor body and in communication with said passage of said sprinkler body;

said restrictor passage having an outer circumferential region in which a helical thread is located and an unobstructed inner region;

wherein water passes substantially straight through said unobstructed inner region and wherein water moves helically through said outer circumferential region.

* * * * *